US009919770B2

(12) United States Patent
Park et al.

(10) Patent No.: US 9,919,770 B2
(45) Date of Patent: Mar. 20, 2018

(54) MOORING APPARATUS FOR OFFSHORE CONSTRUCTION

(71) Applicant: Ocean US Co., Ltd., Busan (KR)

(72) Inventors: Chan Il Park, Busan (KR); Jang Ik Park, Busan (KR); Jeong Yun Moon, Yangsan-si (KR)

(73) Assignee: OCEAN US CO., LTD., Busan (KR)

( * ) Notice: Subject to any disclaimer, the term of this patent is extended or adjusted under 35 U.S.C. 154(b) by 0 days.

(21) Appl. No.: 15/100,366

(22) PCT Filed: Dec. 8, 2014

(86) PCT No.: PCT/KR2014/012021
§ 371 (c)(1),
(2) Date: May 31, 2016

(87) PCT Pub. No.: WO2016/085023
PCT Pub. Date: Jun. 2, 2016

(65) Prior Publication Data

US 2016/0362162 A1 Dec. 15, 2016

(30) Foreign Application Priority Data

Nov. 27, 2014 (KR) ..... 10-2014-0167132

(51) Int. Cl.
*B63B 22/02* (2006.01)
*B63B 21/50* (2006.01)
(Continued)

(52) U.S. Cl.
CPC ..... *B63B 21/507* (2013.01); *B63B 21/10* (2013.01); *B63B 22/02* (2013.01); *B63B 2021/008* (2013.01)

(58) Field of Classification Search
CPC ..... B63B 21/507; B63B 22/02; B63B 21/10; B63B 2021/008
(Continued)

(56) References Cited

U.S. PATENT DOCUMENTS 4,567,843 A * 2/1986 d'Hautefeuille ..... B63B 22/025 114/230.14
5,297,899 A * 3/1994 Culley ..... B63B 35/38 114/266
(Continued)

FOREIGN PATENT DOCUMENTS

KR 2006-0017793 A 2/2006
KR 2010-0124733 A 11/2010
KR 2010-0130666 A 12/2010

OTHER PUBLICATIONS

International Search Report PCT/ISA/210 for International Application No. PCT/KR2014/012021 dated Aug. 24, 2015.
(Continued)

*Primary Examiner* — Anthony D Wiest
(74) *Attorney, Agent, or Firm* — Harness, Dickey & Pierce, P.L.C.

(57) ABSTRACT

The present invention provides a mooring apparatus for an offshore construction that makes it easy to install a mooring chain and can moor an offshore construction stably against external force such as waves and wind. The mooring apparatus for an offshore construction includes; a floating member generating buoyancy; and fixing frames coupled to a side of the floating member and combined with a plurality of fixing arms radially extending and being stretchable and retractable, in which mooring chains which are connected to the bottom of the sea are fixed to free ends of the fixing arms respectively, so that as the fixing arms stretches/retracts on the fixing frame, the positions of the mooring chains change.

9 Claims, 11 Drawing Sheets

(51) Int. Cl.
*B63B 21/10* (2006.01)
*B63B 21/00* (2006.01)

(58) Field of Classification Search
USPC ..... 114/264, 265, 266, 267, 230.1, 230.13, 114/230.14, 230.15, 230.16; 441/1, 3
See application file for complete search history.

(56) References Cited

U.S. PATENT DOCUMENTS 5,305,703 A * 4/1994 Korsgaard ..... B63B 22/023 114/230.1
8,568,063 B2 10/2013 Brinkmann et al.
8,605,540 B2 12/2013 Baker et al.
8,851,004 B2 10/2014 Lavagna et al.
9,003,994 B2 4/2015 Leverette et al.
2003/0024459 A1* 2/2003 Davies ..... B63B 11/02 114/264
2003/0206772 A1* 11/2003 Horne ..... B63B 35/4406 405/224
2009/0084302 A1 4/2009 Daran et al.
2011/0149679 A1 6/2011 Baker et al.
2012/0012044 A1 1/2012 Lavagna et al.
2012/0055388 A1* 3/2012 Liem ..... B63B 21/507 114/230.14
2012/0266801 A1 10/2012 Brinkmann et al.
2013/0233231 A1* 9/2013 Dagher ..... B63B 21/50 114/265
2014/0020616 A1 1/2014 Brinkmann et al.
2014/0026796 A1 1/2014 Leverette et al.
2014/0261131 A1 9/2014 Lavagna et al.
2015/0204302 A1* 7/2015 Kalnay ..... F03B 13/1815 60/498

OTHER PUBLICATIONS

Written Opinion of the International Searching Authority PCT/ISA/237 for International Application No. PCT/KR2014/012021 dated Aug. 24, 2015.

* cited by examiner

[Fig. 1]
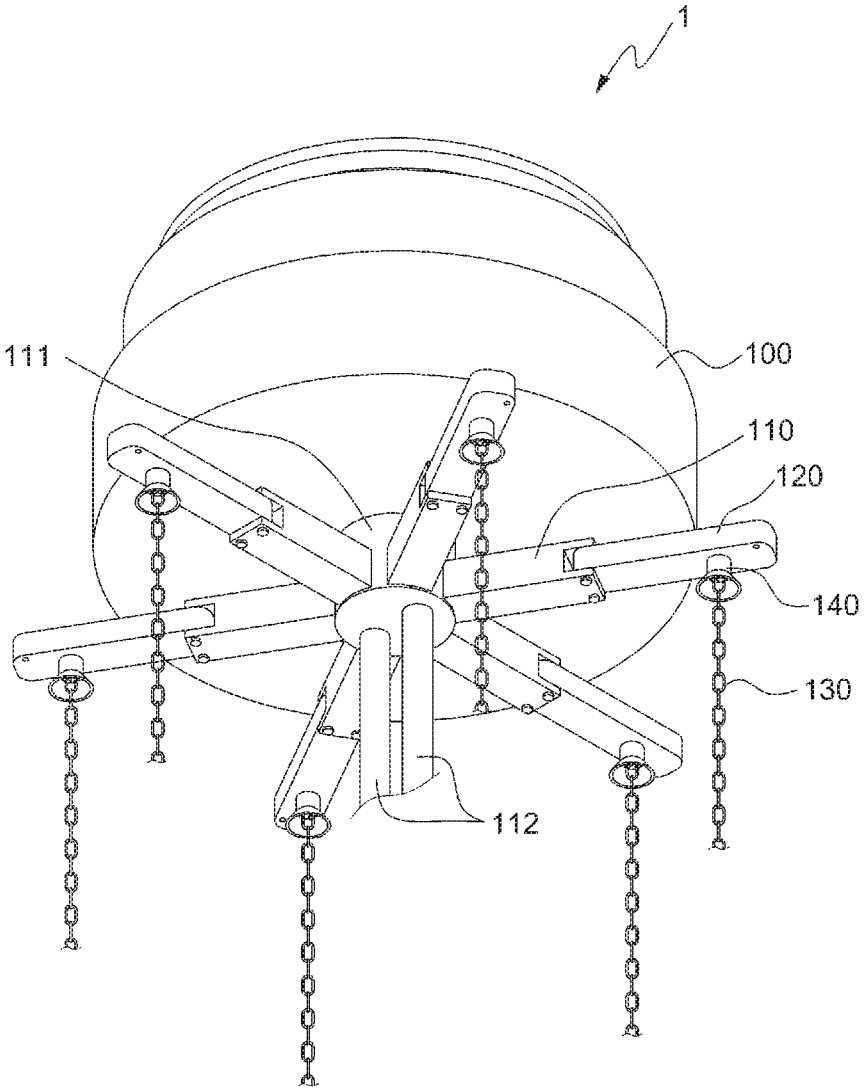

[Fig. 2]
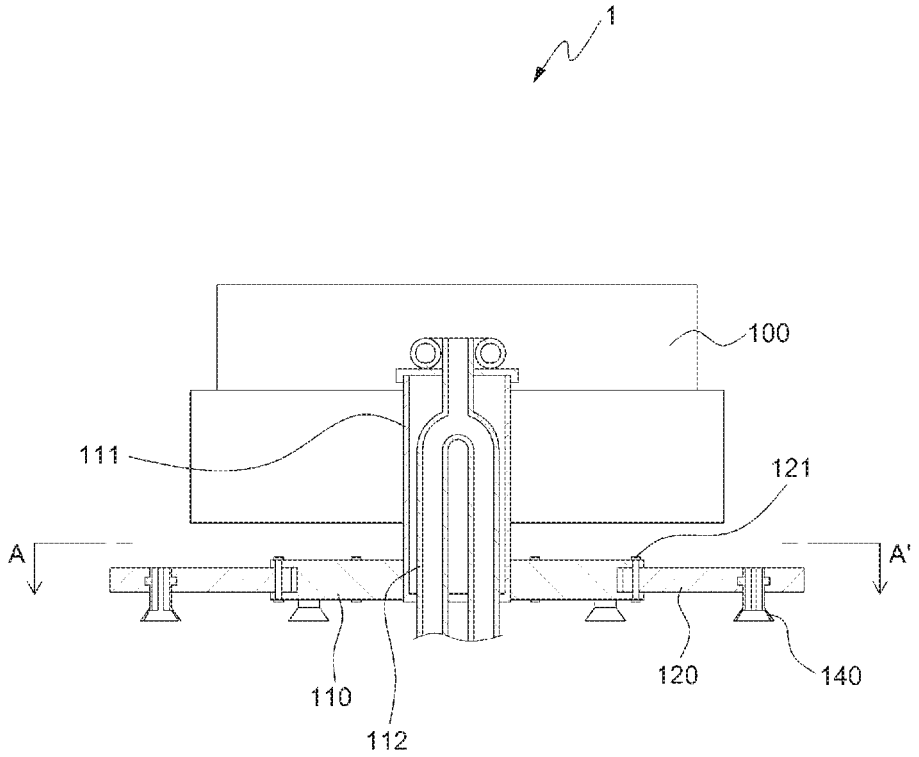
[Fig. 3]
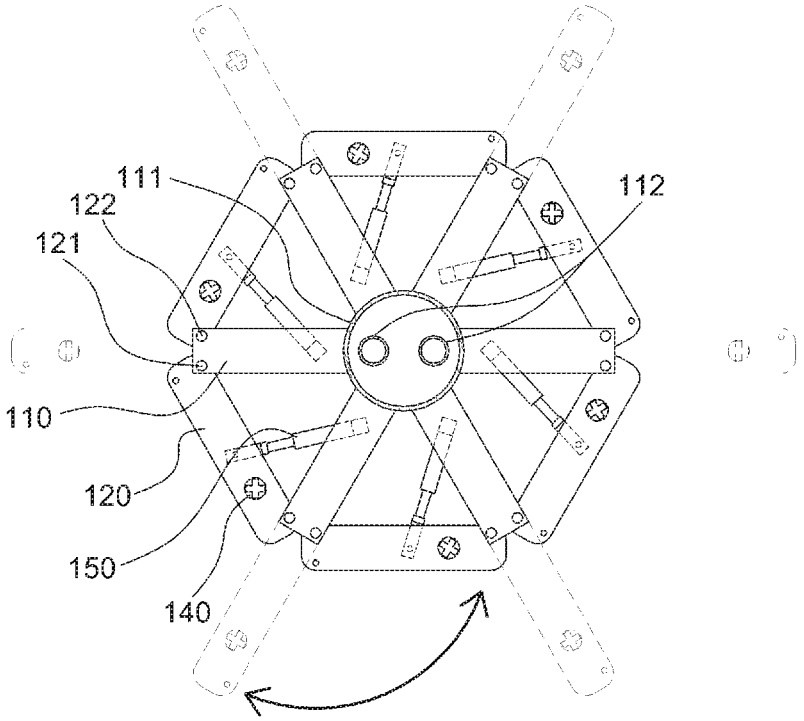

[Fig. 4]
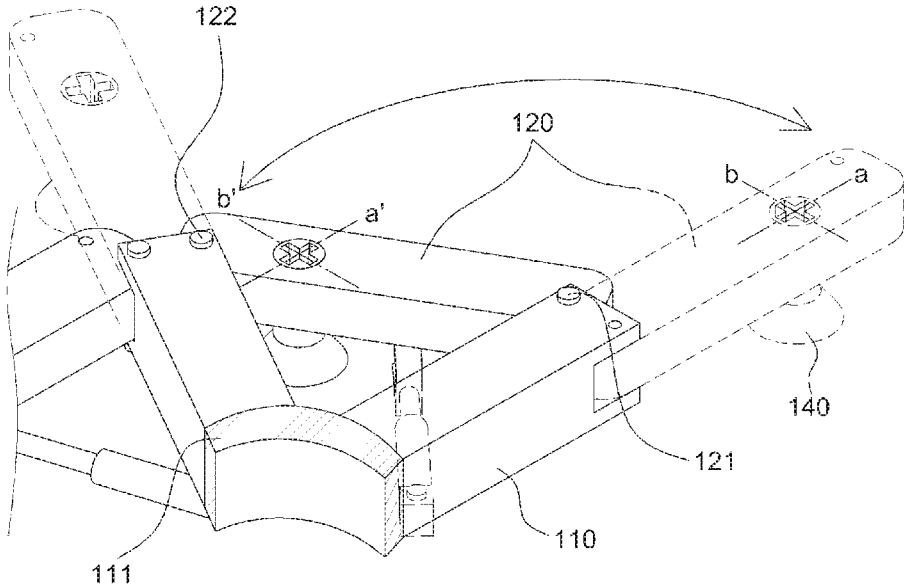
[Fig. 5]
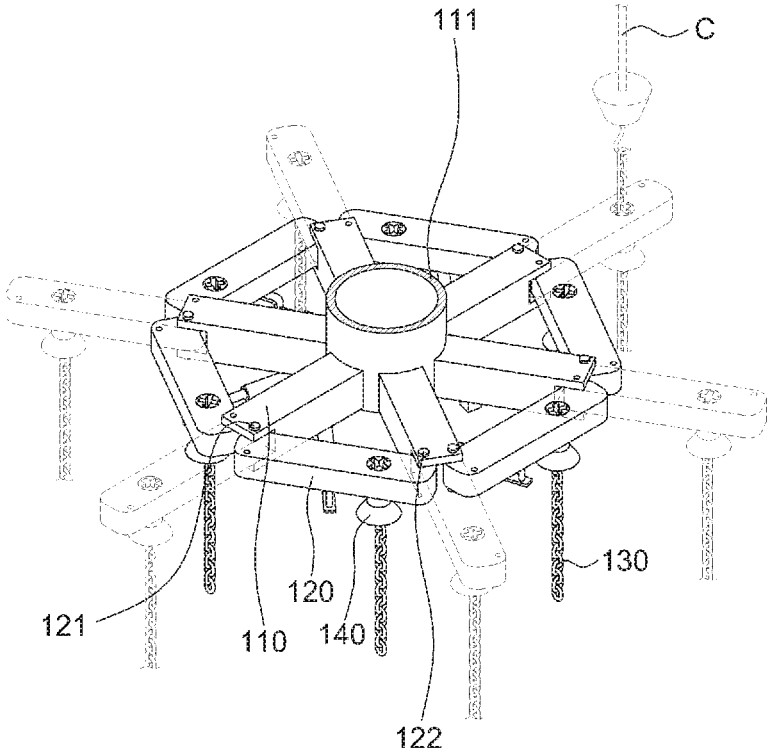

[Fig. 6]
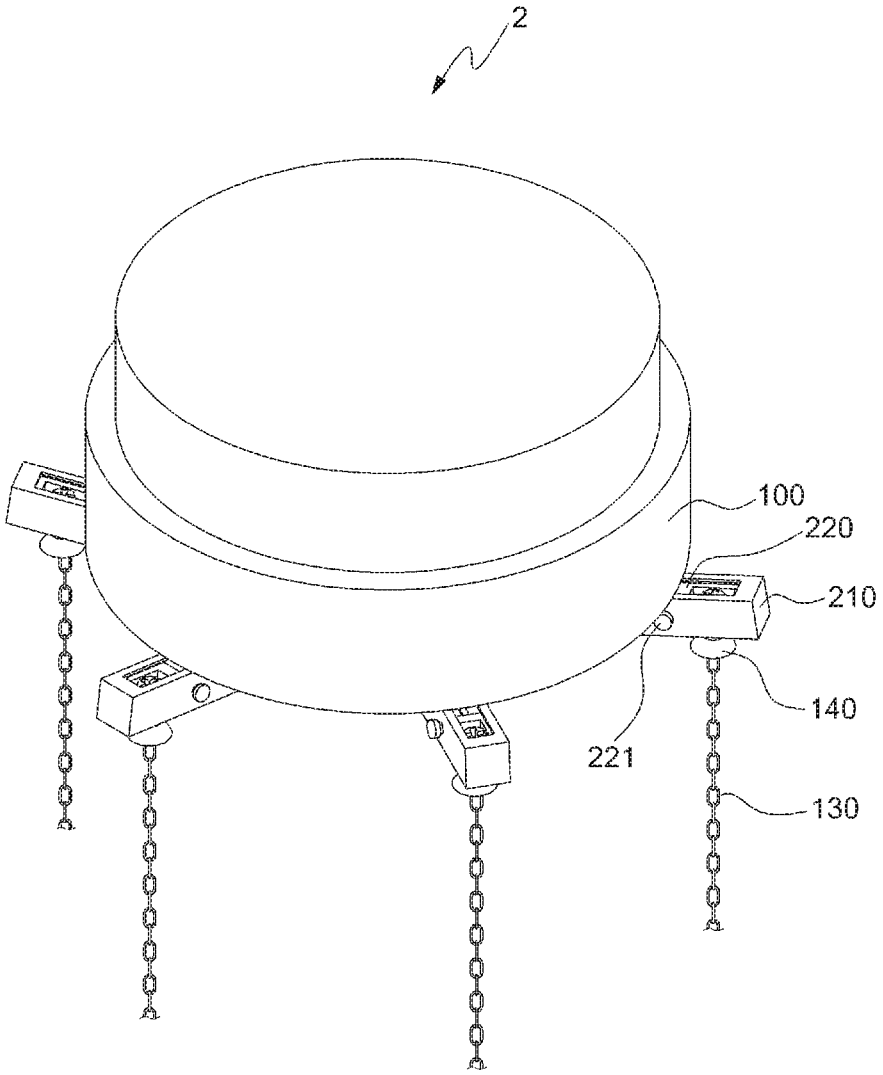

[Fig. 7]
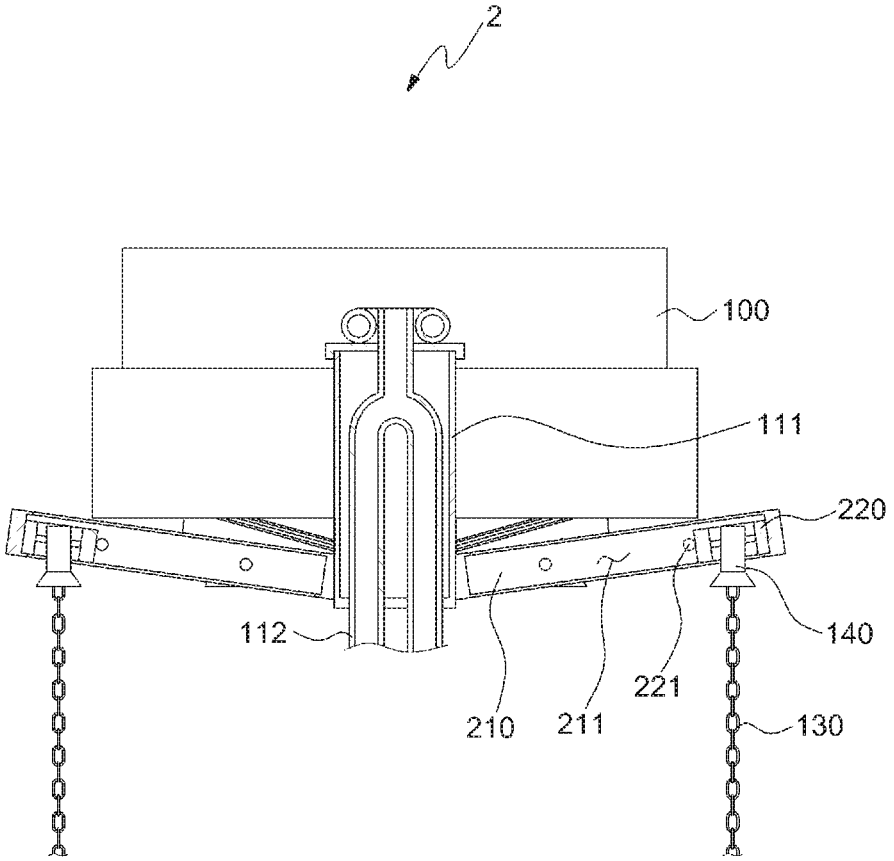

[Fig. 8]
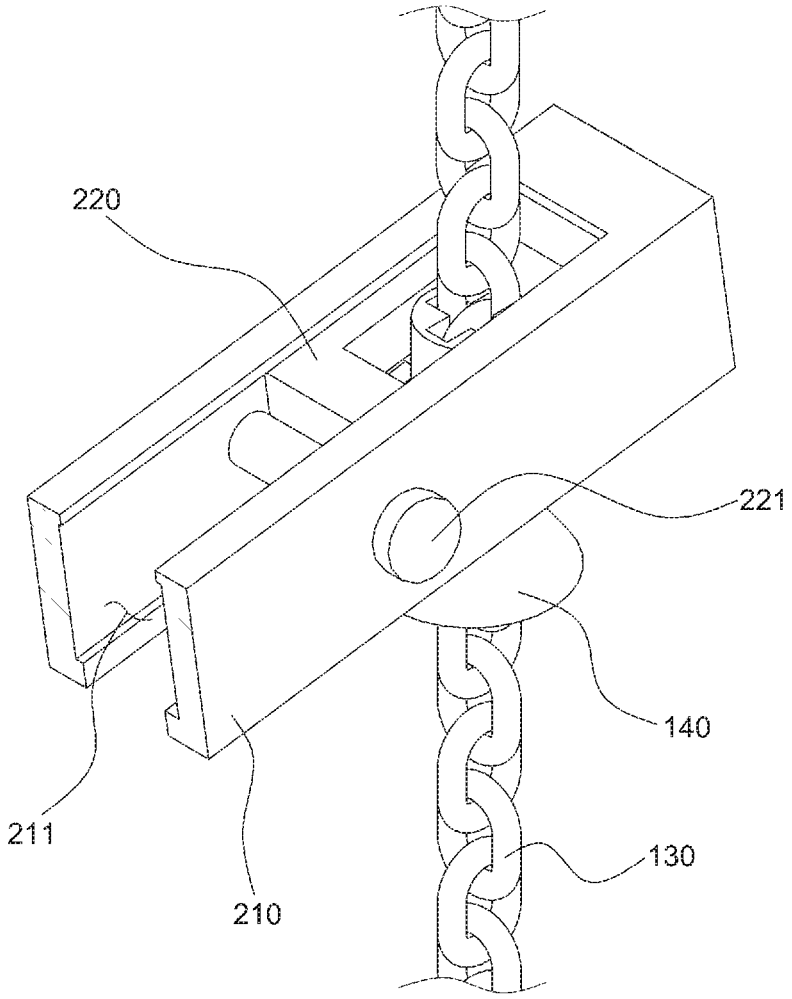

[Fig. 9]
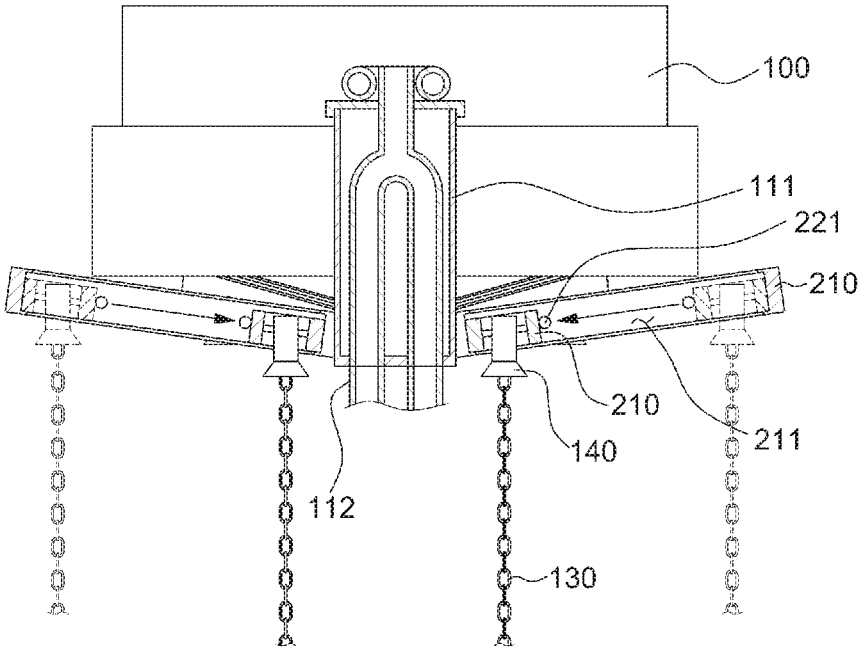

[Fig. 10]
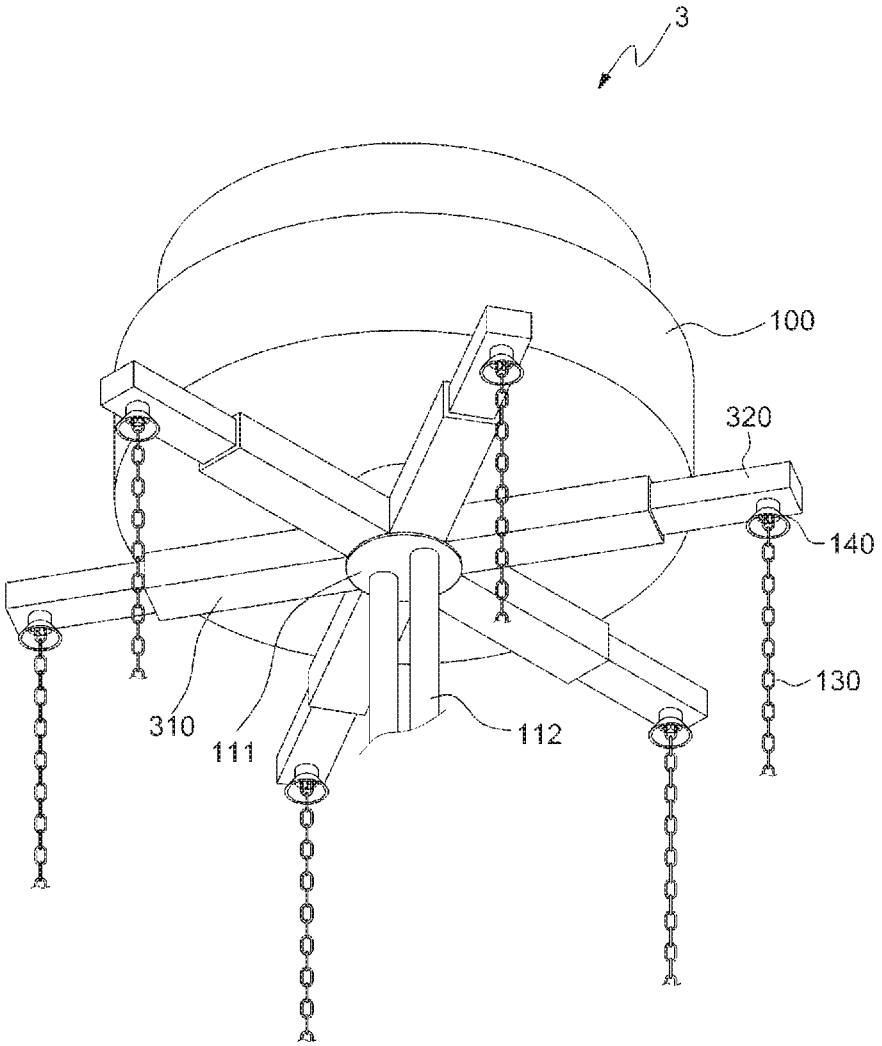

[Fig. 11]
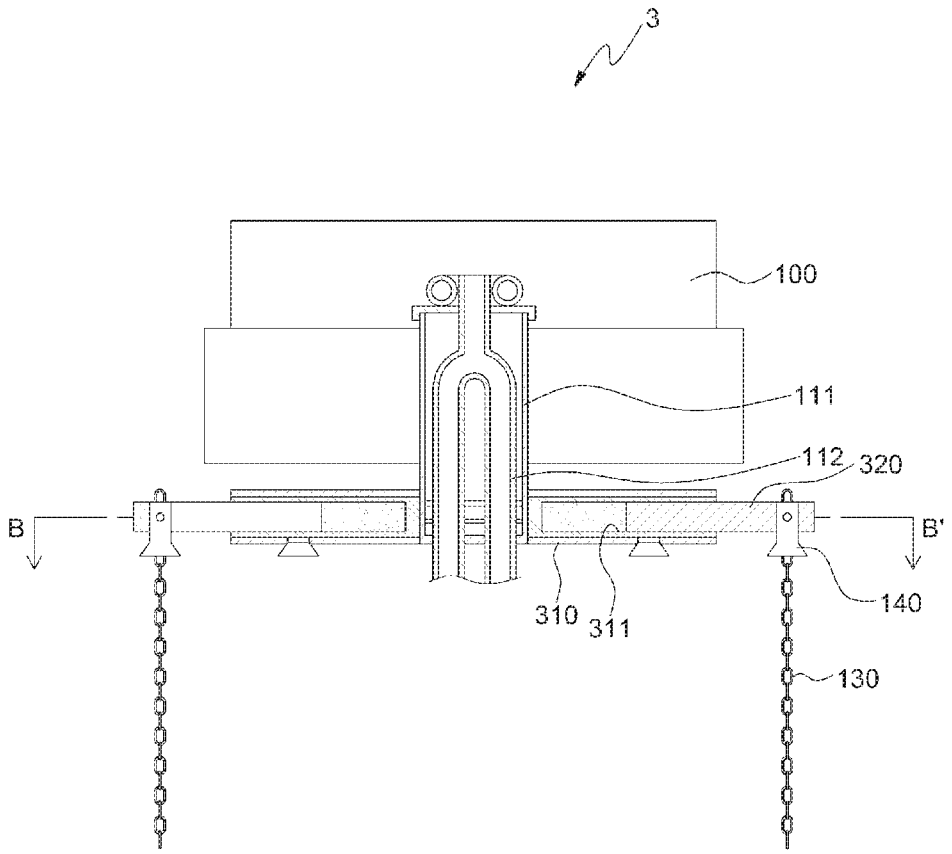

[Fig. 12]
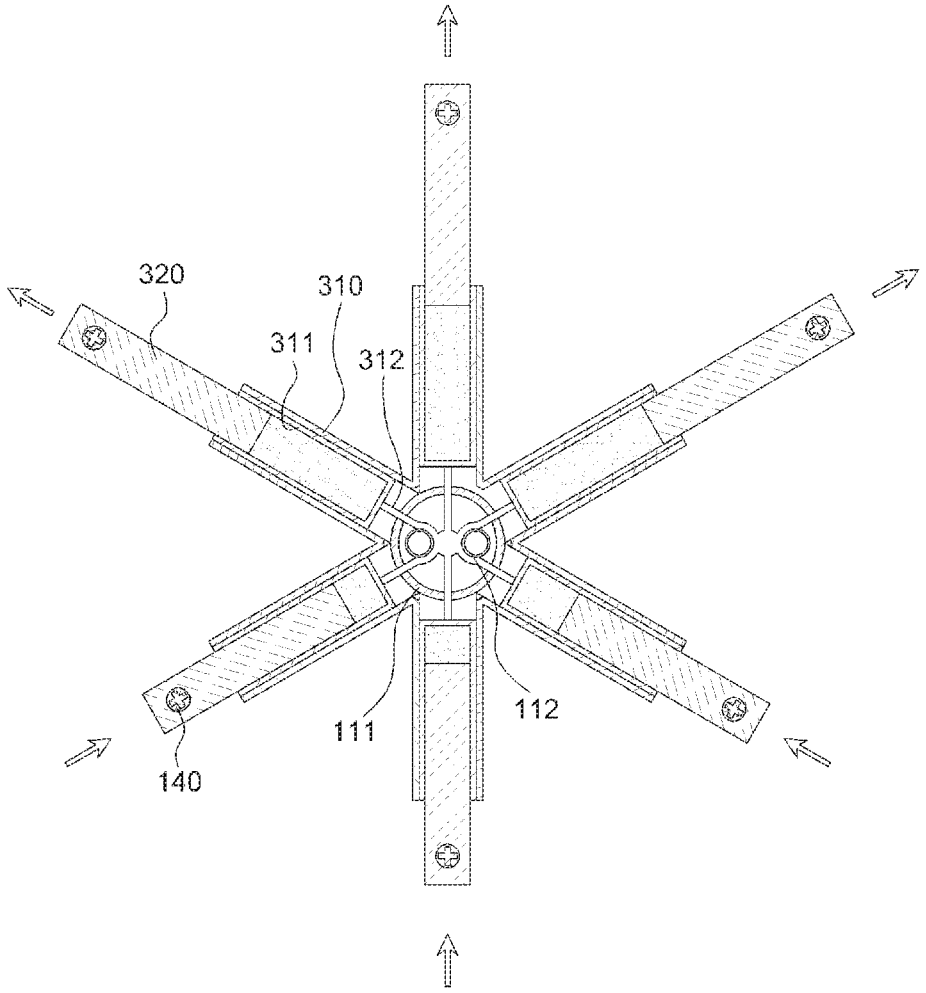

[Fig. 13]
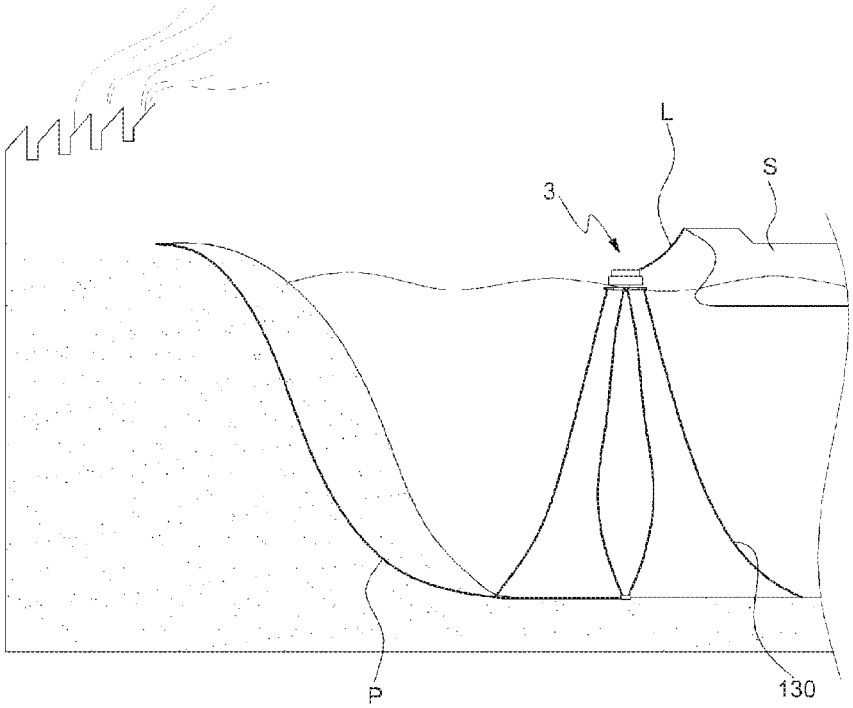
[Fig. 14]
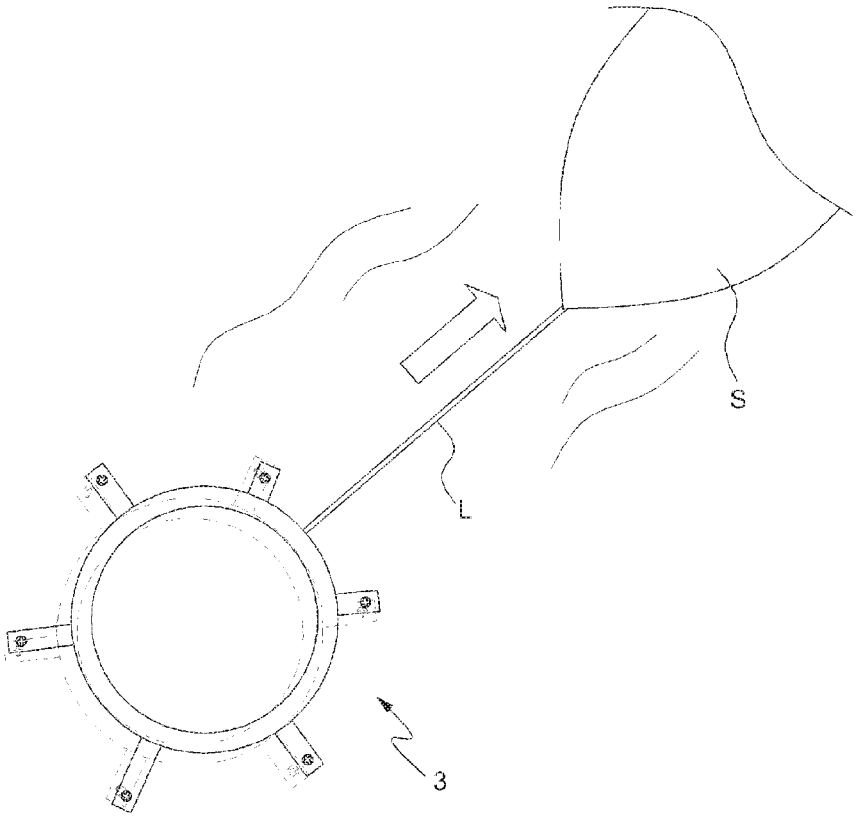

MOORING APPARATUS FOR OFFSHORE CONSTRUCTION

TECHNICAL FIELD

The present invention relates to a mooring apparatus for an offshore construction, and more particularly, to a mooring apparatus for an offshore construction that makes it easy to install a mooring chain and can moor an offshore construction stably against external force such as waves and wind.

BACKGROUND ART

There are large amounts of various underground resources such as natural gas and oil under the deep sea. Various offshore constructions have been developed to mine those underground resources and various efforts have been made to mine resources under the deep sea under an extreme environment.

Various offshore constructions working on the sea, including ships, require a mooring apparatus for maintaining their positions against external force such as waves, wind, and currents. A turret that can turn around a predetermined position to make it possible to load and process underground resources even if offshore constructions are moved by waves, wind, or currents is generally used for those mooring apparatuses. The turret is a device that is combined directly with offshore constructions such as a ship or connected to offshore constructions through a hawser on the sea and keeps the offshore constructions at a position.

The turret maintains its position on the sea, using a plurality of mooring chains connected to the bottom of the sea. However, large tension is exerted in mooring chains extending to the deep sea, so it is difficult to connect them to a turret.

Further, the positions of mooring chains connected to a turret have a large influence on the stability of the turret, so there is a need for a turret that can be easily installed and stably floated on the sea.

Korean Patent Application Publications No. 10-2010-0124733 (2010 Nov. 29) discloses an example turret and a floating supporting fitted with the turret according to a conventional art.

DISCLOSURE OF INVENTION

Technical Problem

The present invention has been made in an effort to provide a mooring apparatus for an offshore construction that makes it easy to install a mooring chain and can moor an offshore construction stably against external force such as waves and wind.

The objects of the present invention are not limited to those described above and other objects may be made apparent to those skilled in the art from the following description.

Solution to Problem

According to an aspect of the present invention, there is provided a mooring apparatus for an offshore construction that includes: a floating member generating buoyancy; and fixing frames coupled to a side of the floating member and combined with a plurality of fixing arms radially extending and being stretchable and retractable, in which mooring chains which are connected to the bottom of the sea are fixed to free ends of the fixing arms respectively, so that as the fixing arms stretches/retracts on the fixing frame, the positions of the mooring chains change.

The fixing arms may be coupled to the fixing frames in the way of a hinge to fold/unfold.

The apparatus may further include actuators having both ends fixed between the fixing frames and the fixing arms and folding/unfolding the fixing arms by stretching or contracting.

The fixing arms may pivot on hinge shafts fixed to the fixing frames and the free ends may be fixed to the fixing frames.

The fixing arms may be fixed to the fixing frames by hinge shafts and fixing pins passing through both of the fixing frames and the fixing arms close to the hinge shafts, when being unfolded, and they may be fixed to the fixing pins of adjacent fixing arms, when being folded.

The fixing arms may radially slide with respect to the fixing frames.

Guide rails may be radially formed at predetermined sides of the fixing frames and the fixing arms may be combined to be able to move along the guide rails.

The fixing arms may be connected to a plurality of fluid cylinders fixed to the fixing frames and at least some of the fluid cylinders may operate in combination with each other and share working fluid.

The apparatus may further include chain guides preventing the mooring chains from rotating and rotatably coupled to the fixing arms.

The fixing frames may be turnably combined with the floating member.

A hawser connected to an offshore construction on the sea may be connected to an end of the floating member.

Advantageous Effects of Invention

According to the present invention, it is possible to increase efficiency in work and stably moor various offshore constructions against waves, wind, or currents since mooring chains can be easily installed on the sea.

In particular, it is possible to uniformly distribute tension on mooring chains, so it is possible to prevent concentration of tension on specific mooring chains.

BRIEF DESCRIPTION OF DRAWINGS

FIG. 1 is a bottom perspective view of a mooring apparatus for an offshore construction according to a first embodiment of the present invention.

FIG. 2 is a longitudinal cross-sectional view of the flooring apparatus for an offshore construction shown in FIG. 1.

FIG. 3 is a cross-sectional view of the mooring apparatus for an offshore construction shown in FIG. 2 taken along line A-A'.

FIG. 4 is a perspective view of a fixing frame and a fixing arm of the mooring apparatus for an offshore construction shown in FIG. 1.

FIG. 5 is a perspective view of the fixing frames and the fixing arms in the process of installing the mooring apparatus for an offshore construction shown in FIG. 1.

FIG. 6 is a bottom perspective view of a mooring apparatus for an offshore construction according to a second embodiment of the present invention.

FIG. 7 is a longitudinal cross-sectional view of the mooring apparatus for an offshore construction shown in FIG. 6.

FIG. 8 is a partial perspective view of a fixing frame and a fixing arm of the mooring apparatus for an offshore construction shown in FIG. 6.

FIG. 9 is a perspective view of fixing frames and fixing arms in operation of the mooring apparatus for an offshore construction shown in FIG. 6.

FIG. 10 is a bottom perspective view of a mooring apparatus for an offshore construction according to a third embodiment of the present invention.

FIG. 11 is a longitudinal cross-sectional view of the mooring apparatus for an offshore construction shown in FIG. 10.

FIG. 12 is a cross-sectional view taken along line B-B' for illustrating operation of the mooring apparatus for an offshore construction shown in FIG. 11.

FIGS. 13 and 14 are views showing example of use of the mooring apparatus for an offshore construction shown in FIG. 10.

MODE FOR THE INVENTION

The advantages and features of the present invention, and methods of achieving them will be clear by referring to the exemplary embodiments that will be describe hereafter in detail with reference to the accompanying drawings. However, the present invention is not limited to the embodiments described hereafter and may be implemented in various ways, so the exemplary embodiments are provided to complete the description of the present invention and to let those skilled in the art completely know the scope of the present invention, and the present invention is defined by claims. Like reference numerals indicate the same components throughout the specification.

Hereinafter, a mooring apparatus for an offshore construction according to a first embodiment of the present invention will be described in detail with reference to FIGS. 1 to 5.

FIG. 1 is a bottom perspective view of a mooring apparatus for an offshore construction according to a first embodiment of the present invention, FIG. 2 is a longitudinal cross-sectional view of the mooring apparatus for an offshore construction shown in FIG. 1, and FIG. 3 is a cross-sectional view of the mooring apparatus for an offshore construction shown in FIG. 2 taken along line A-A'.

A mooring apparatus 1 for an offshore construction according to a first embodiment of the present invention moors an offshore construction such as a ship at a predetermined position on the sea and connects various pieces of equipment to make it possible to load undersea resources and operate undersea equipment. That is, the mooring apparatus 1 for an offshore construction moors an offshore construction within a predetermined range to make it possible to work with undersea equipment.

The mooring apparatus 1 for an offshore construction may be combined directly with an offshore construction or connected to an offshore construction through a hawser. The mooring apparatus 1 for an offshore construction may be implemented in the type of a turret to be able to always turn around a point, even if an offshore construction is moved by wind, waves, or currents. The mooring apparatus for an offshore construction according to the present invention includes all of offshore constructions or single point mooring apparatuses connected to an offshore construction through a hawser, in addition to a mooring apparatus directly combined with an offshore construction such as a ship. A single point mooring apparatus for an offshore construction is exemplified herein.

Further, the term 'offshore construction' used herein means all of various structures on the sea, including not only structures with a thrust system such as a ship hut all of structures that are pulled by a barge etc. without a thrust system.

Hereinafter, a mooring apparatus for an offshore construction according to a first embodiment of the present invention will be described in detail with reference to FIGS. 1 to 3.

The flooring apparatus 1 for an offshore construction includes a floating member 100 that generates buoyancy on the sea and fixing frames 110 that is coupled to a side of the floating member 100 and to which mooring chains 130 are connected.

The floating member 100 may be made of a buoyant material or may be a hollow floating tank. The floating member 100, as shown in FIG. 2, may be a structure maintaining the basic frame of the mooring apparatus 1 for an offshore construction. However, it is not limited thereto and may be combined with a structure that is the basic structure.

The floating member 100 may keep predetermined buoyancy or may be a ballast tank controlling buoyancy, if necessary. The floating member 100 may float the mooring apparatus 1 for an offshore construction for a predetermined period or may provide buoyancy capable of keeping the mooring apparatus 1 for an offshore construction at a predetermined position in the sea.

The fixing frames 110 are coupled to the bottom of the floating member 100. The fixing frames 110 can fix the floating member 100 at a predetermined position on the sea by being fixed to the mooring chains 130. The mooring chains 130 are connected to the fixing frames 110 through fixing arms 120.

The fixing arms 120, parts making it possible to changing the fixing position of the mooring chains 130, may be connected to the fixing frames 110 in various ways, for example, extending from the fixing frames 110 or inserted in the fixing frames 110.

The fixing frames 110 may radially extend as shown in FIG. 1, but they are not limited thereto and may be implemented in any shape as long as the fixing arms 120 can radially extend. For example, the fixing frames 110 may be formed in a cylindrical shape or a polygonal shape.

The fixing frames 110 can be coupled to the floating member 100 by a turret shaft 111. That is, the fixing frames 110 may be turnably coupled to the floating member 100. Accordingly, even if the fixing frames 110 are fixed and restricted in turning by the mooring chains 130, the floating member 100 can freely turn.

The turret shaft 111 may have swivel pipes 112 therein that combine a riser extending under the sea and a pipe connected to an offshore construction such that they can rotate. The turret shaft 111 may receive a connector therein to which various cables that can operate devices under the sea can be connected.

The fixing arm 120 is coupled to a free end of the fixing frame 110 to be extendable. The fact that the fixing arm 120 is extendable means not only that the fixing arm 120 changes in length, but that the fixing arm 120 moves or turns such that the circumferential position of the mooring chain 130 changes. Several examples for the extendible structure of the fixing arm 120 will be described hereafter, but it is not limited thereto and any structure may be used as long as the circumferential position of the mooring chain 130 can be chanted by operation of the fixing arm 120.

First, referring to FIGS. 2 and 3, the fixing arms 120 are hinged to the fixing frames 110 to be folded/unfolded. The fixing arm 120 may be combined with the fixing frame 110 by one hinge shaft 121 and one fixing pin 122. The hinge shaft 121 is a pivot of the fixing arm 120 that is folding and the fixing pin 122 fixes the fixing arm 120 to the fixing frame 110 by passing through both of the fixing frame 110 and the fixing arm 120. The fixing pin 122, as shown in FIG. 3, fixes the fixing arm 120 to the fixing frame 110, even through the fixing arm 120 has been folded.

The fixing arm 120 can be pivoted on the hinge shaft 121 by an actuator 150. The actuator 150 has both ends fixed between the fixing frame 110 and the fixing arm 120 and folds or unfolds the fixing arm 120 about the hinge shaft 121 by stretching or retracting. The actuator 150 may be implemented by a fluid cylinder or a pneumatic cylinder, so it may be operated by hydraulic pressure or pneumatic pressure or a motor.

The actuator 150 may be permanently fixed to the fixing frame 110 or may be detachably fixed thereto so that it can be fixed for use, if necessary.

A chain guide 140 that prevents the mooring chain 130 from turning and twisting is coupled to the fixing arm 120. The chain guide 140 is disposed between the mooring chain 130 and the fixing arm 120 and has a cross ('+')-shape hole, so it prevents the mooring chain 130 from turning. The chain guide 140 is rotatably coupled to the fixing arm 120.

The combination structure of the fixing frame 110 and the fixing arm 120 is described with reference to FIG. 4. FIG. 4 is a perspective view of a fixing frame and a fixing arm of the mooring apparatus for an offshore construction shown in FIG. 1.

The fixing arm 120 is fixed by the hinge shaft 121 and the fixing pin 122, when it is unfolded. The fixing pin 122 passes through both of the fixing frame 110 and the fixing arm 120, close to the hinge shaft 121. The cross ('+')-shaped hole of the chain guide 140 is arranged in the directions 'a' and 'b'. The mooring chain 130 is connected to the fixing arm 120, with the fixing arm 120 unfolded.

When the fixing pin 122 is removed and the fixing arm 120 pivots on the hinge shaft 121, the fixing arm 120 is folded. When the fixing arm 120 is folded, it is fixed to the fixing frame 110 by the fixing pin 122 fixing an adjacent fixing arm 120. When the fixing arm 120 is fixed by the fixing in 122 of an adjacent fixing arm, the mooring chain 130 is moved inward toward the turret shaft 111.

The cross ('+')-shaped hole of the chain guide 140 is arranged in the directions a' and b' in this position. The chain guide 140 is rotatably coupled to the fixing arm 120 and the mooring chain 130 has an own resistance force, so the directions a and a' are substantially the same and the directions b and b' are also substantially the same. That is, the chain guide 140 keeps the direction due to the resistance force of the mooring chain 130 even though it is moved with the mooring chain 130, so the mooring chain 130 is not twisted.

The process of the mooring apparatus for an offshore construction is described with reference to FIG. 5.

FIG. 5 is a perspective view of the fixing frames and the fixing arms in the process of installing the mooring apparatus for an offshore construction shown in FIG. 1.

In the mooring apparatus 1 for an offshore construction, the mooring chain 130 is fixed, with the fixing arm 120 fully unfolded from the fixing frame 110. When the fixing arm 120 is fully unfolded from the fixing frame 110, the chain guide 140 can protrude outside the floating member 100. Accordingly, the mooring chain 130 can be easily lifted by a crane installed at the outside. In this state, the tension on the mooring chain 130 reduces and a space is generated in the work space, thereby increasing safety in work.

As shown in FIG. 5, when the mooring chains 130 are connected to all of six fixing arms 120, the fixing pins 122 are separated from the fixing frames 110 and the fixing arms 120 are folded by operating the actuators 150. When all the fixing arms 120 are folded, they are fixed in the folded positions by inserting the fixing pins 122 back into their positions. When the fixing arms 120 are fully folded, the mooring chains 130 are close to the turret shaft 111 and can be fully lifted to the bottom of the floating member 100.

As the mooring chains 130 are moved close to the turret shaft 111, the joints of the mooring chains 130 come closer to each other, such that a change in tension on the mooring chains 130 can be minimized, even if an external force is applied to the flooring apparatus 1 for an offshore construction.

Hereinafter, a mooring apparatus for an offshore construction according to a second embodiment of the present invention will be described in detail with reference to FIGS. 6 to 9.

FIG. 6 is a bottom perspective view of a mooring apparatus for an offshore construction according to a second embodiment of the present invention, FIG. 7 is a longitudinal cross-sectional view of the mooring apparatus for an offshore construction shown in FIG. 6, and FIG. 8 is a partial perspective view of a fixing frame and a fixing arm of the mooring apparatus for an offshore construction shown in FIG. 6.

In a mooring apparatus 2 for an offshore construction according to a second embodiment of the present invention, fixing arms 220 are combined with fixing frames 210 and can slide with respect to the fixing frames 210. The mooring apparatus 2 for an offshore construction according to an embodiment of the present invention has a structure substantially the same as that of the first embodiment, except the structure of fixing frames 210 and fixing arms 220. Accordingly, the same components as those of the first embodiments are given the same reference numerals and are not described.

Referring to FIGS. 6 and 7, the fixing frames 210 radially extend outside the floating member 100. Guide rails 211 are formed inside the fixing frames 210 to enable the fixing arms 220 to slide. Although the guide rail 211 is formed inside the fixing frame 210 in the second embodiment of the present invention, as shown in FIG. 7, it is not thereto and may be formed at any position on the fixing frame 210. For example, when the fixing arm 220 slides outside the fixing frame 210, the guide rail 211 may not be formed in the shape a groove, but protrude. That is, the guide rail 211 may be formed in any structure as long as it can guide the fixing arm 220 sliding with respect to the fixing frame 210.

The fixing frames 210 incline upward, as they radially extend. Since the mooring chains 130 are usually radially extended and fixed under the sea, no the fixing frames 210 incline toward the outside to easily pull and fix the mooring chains 130.

In particular, as the fixing frames 210 incline upward, the guide rails 211 also incline along the fixing frames 210. Since the guide rails 211 incline upward, as described above, the fixing arms 220 connected with the mooring chains 130 can easily slide.

Referring to FIG. 8, the fixing arm 220 is slidably combined with the guide rail 211.

The fixing arm 220 may have the shape of a block and a chain guide 140 is rotatably coupled to the fixing arm 220.

The chain guide 140 coupled to the fixing arm 220 can not only rotate to prevent the mooring chain 130 from twisting, but swing to be able to move in the hanging-down direction of the mooring chain 130.

The fixing arm 220 can be fixed at a position where the mooring chain 130 is mounted, by a fixing pin 221.

Hereinafter, the process of installing the mooring apparatus for an offshore construction according to the second embodiment of the present invention is described with reference to FIG. 9. FIG. 9 is a perspective view of fixing frames and fixing arms in operation of the mooring apparatus for an offshore construction shown in FIG. 6.

As described above, the mooring chains 130 are fixed, with the fixing arms 220 radially moved along the guide rails 211 and then fixed. The mooring chain 130 is combined, after the fixing arm 220 is move radially as far as possible.

Next, the fixing pin 221 inserted in the fixing frame 210 is separated and then the fixing arm 220 is moved toward the turret shaft 111. After the fixing arm 220 is moved, the fixing arm 220 is fixed by the fixing pin 221.

Hereinafter, a mooring apparatus for an offshore construction according to a third embodiment of the present invention will be described in detail with reference to FIGS. 10 to 13.

FIG. 10 is a bottom perspective view of a mooring apparatus for an offshore construction according to a third embodiment of the present invention, FIG. 11 is a longitudinal cross-sectional view of the mooring apparatus for an offshore construction shown in FIG. 10, and FIG. 12 is a cross-sectional view taken along line B'B' for illustrating operation of the mooring apparatus for an offshore construction shown in FIG. 11.

In a mooring apparatus 3 for an offshore construction according to a third embodiment of the present invention, fixing arms 320 can radially slide with respect to fixing frames 310 and are operated in combination with each other by fluid cylinders 311. The mooring apparatus 3 for an offshore construction according to an embodiment of the present invention has a structure substantially the same as that of the first embodiment, except the structure of the fixing frames 310 and the fixing arms 320. Accordingly, the same components as those of the first embodiments are given the same reference numerals and are not described.

In the third embodiment of the present invention, the fixing arms 320 are coupled to the fluid cylinders 311 fixed to the fixing frames 310 and the fluid cylinders 311 are at least partially connected to share working fluid. That is, when some of the fixing arms 320 move, the others move accordingly.

Referring to FIGS. 10 and 11, in detail, the fixing frames 310 radially extend from the turret shaft 111 and the fixing arms 320 are fixed to the fixing frames 310, respectively. The fixing frames 310 include the fluid cylinders 311 and each of the fluid cylinders 311 are coupled to the fixing arms 320 respectively. The fluid cylinders 311 may be disposed inside the fixing frames 310 as shown in FIG. 11, but they are not limited thereto and may be coupled to the fixing arms 320 outside the fixing frames 310.

The fluid cylinder 311 can send the working fluid to another fluid cylinder by means of the fixing arm 320 or can press the fixing arm 320 using the working fluid sent from another fluid cylinder. That is, the fluid cylinders 311 operate in combination with each other, so the fixing arms 320 also operate in combination with each other.

The fluid cylinders 311 is operated by the working fluid therein and the working fluid may be incompressible fluid such as oil or compressible fluid such as a gas. That is, the fluid cylinder 311 may be any type of cylinder as long as it can press the fixing arm 320, using working fluid therein, such as a hydraulic cylinder or a pneumatic cylinder.

Referring to FIG. 12, the fixing arms 320 are connected to each other by connection pipes 312, which connect the fluid cylinders 311, so they operate in combination with each other. For example, when some of the fixing arms 320 are moved toward the turret shaft 111 by an external force, the fixing arms 320 receiving a relatively small external force in the other fixing arms 320 are moved outward.

As shown in FIG. 12, when some of the fixing arms 320 operate in combination with each other and move inward, some of the fixing arms 320 can move outward. The fixing arms 320 and the fixing frames 310 relatively move, so actually, the fixing am's 320 are fixed by the mooring chains 130, and the fixing frames 310 and the floating member 100 can be moved in the direction of an external force. Accordingly, even if the floating member 100 is moved in a predetermined direction by an external force such as waves or currents, the fixing arms 320 are maintained at almost their positions, so the floating member 100 can be fixed at the position where the tension on the fixing arms 320 makes equilibrium.

FIGS. 13 and 14 are views showing example of use of the mooring apparatus for an offshore construction shown in FIG. 10. In detail, FIGS. 13 and 14 show a ship S moored by the mooring apparatus 3 for an offshore construction according to the third embodiment of the present invention.

The mooring apparatus 3 for an offshore construction is a single point flooring apparatus that mores an offshore construction such as the ship S, on the sea. The mooring apparatus 3 for an offshore construction is moored by mooring chains 130 and connected with a pipe line P under the sea. The pipe line P is connected to the ship S through the mooring apparatus 3 for an offshore construction so that liquid cargo can be loaded/unloaded on/from the ship S.

The ship S is connected to the mooring apparatus 3 for an offshore construction by a hawser L. The hawser L can connect the floating member 100 of the mooring apparatus 3 for an offshore construction with the ship S. Accordingly, the ship S can be moored around the mooring apparatus 3 for an offshore construction, even if it is influenced by wind, waves, or currents.

Referring to FIG. 14, the ship S is connected to the mooring apparatus 3 for an offshore construction and pulls the mooring apparatus 3 for an offshore construction in the direction of an arrow due to an external force such as wind, waves, and currents. In this state, the fixing arms 320 are not moved much because they are connected to the mooring chains 130, but the floating member 100 is pulled and moved by the ship S.

That is, the fixing arms 320 extending in the pulling direction of the ship S are compressed and shortened, whereas the fixing arms 320 extending opposite to the pulling direction of the ship S are stretched by tension. The external force applied to the fixing arm 320 extending in the pulling direction of the ship S is transmitted to other fixing arms 320 through the fluid cylinder 311 and the fixing arms 320 make equilibrium where the external forces make equilibrium. Accordingly, the tension on the mooring chains 130 fixed to the fixing arms 320 makes equilibrium.

Although embodiments of the present invention were described above with reference to the accompanying drawings, those skilled in the art would understand that the present invention may be implemented in various ways without changing the necessary features or the spirit of the prevent invention. Therefore, the embodiments described above are only examples and should not be construed as being limitative in all respects.

The invention claimed is:

1. A mooring apparatus for an offshore construction, comprising:

a floating member generating buoyancy;

fixing frames coupled to a side of the floating member;

fixing arms combined with the fixing frames, the fixing arms extending in a radial manner and configured to stretch and retract on the fixing frames, respectively; and mooring chains fixed to free ends of the fixing arms, respectively, such that the fixing frames fix the floating member at a position on the sea by being fixed to the mooring chains, the fixing arms configured to change positions of the mooring chains, wherein the fixing arms are hinged to the fixing frames by way of hinge shafts, respectively, to be folded/unfolded, the fixing arms are configured to pivot about the hinge shafts, respectively, and the fixing arms are coupled to free ends of the fixing frames, respectively.

2. The apparatus of claim 1, further comprising:

actuators each having both ends fixed between a corresponding pair of one of the fixing frames and one of the fixing arms, the actuators configured to fold/unfold the fixing arms, respectively, by stretching/contracting.

3. The apparatus of claim 1, further comprising:

fixing pins passing through corresponding pairs of one of the fixing frames and one of the fixing arms, respectively, and being close to the hinge shafts, respectively, wherein the fixing arms are configured to be fixed to the fixing frames by pairs of one of the hinge shafts and one of the fixing pins, respectively, when unfolded, and the fixing arms are configured to be fixed to the fixing pins adjacent to corresponding ones of the fixing arms, respectively, when folded.

4. The apparatus of claim 1, further comprising:

chain guides rotatably coupled to the fixing arms, respectively, the chain guides configured to rotate and swing with respect to a hanging-down direction of the mooring chains.

5. The apparatus of claim 1, wherein the fixing frames are turnably combined with the floating member such that the floating member moves freely regardless of whether the fixing frames are fixed and/or restricted in turning by the mooring chains.

6. The apparatus of claim 1, further comprising:

a hawser configured to connect an offshore construction on the sea to the floating member.

7. A mooring apparatus for an offshore construction, comprising:

a floating member generating buoyancy;

fixing frames coupled to a side of the floating member;

fixing arms combined with the fixing frames, the fixing arms extending in a radial manner, the fixing arms configured to stretch and retract on the fixing frames, respectively, and radially slide with respect to the fixing frames, respectively; and mooring chains fixed to free ends of the fixing arms, respectively, such that the fixing frames fix the floating member at a position on the sea by being fixed to the mooring chains, the fixing arms configured to change positions of the mooring chains.

8. The apparatus of claim 7, further comprising:

guide rails at least one of sides of the fixing frames, the guide rails configured to guide the fixing arms to move along the guide rails.

9. The apparatus of claim 7, further comprising:

fluid cylinders fixed to the fixing frames, respectively, the fluid cylinders at least partially connect to each other to share working fluid, wherein the fixing arms are connected to the fluid cylinders, respectively, and are configured to operate in combination with each other by the fluid cylinders.

* * * * *